US011240904B2

(12) United States Patent
Lukens et al.

(10) Patent No.: US 11,240,904 B2
(45) Date of Patent: Feb. 1, 2022

(54) APPARATUS FOR AND METHOD OF CONTROLLING COALESCENCE OF DROPLETS IN A DROPLET STREAM

(71) Applicant: ASML Netherlands B.V., Veldhoven (NL)

(72) Inventors: Joshua Mark Lukens, San Diego, CA (US); Bob Rollinger, San Diego, CA (US); Pooriya Beyhaghi, San Diego, CA (US)

(73) Assignee: ASML Netherlands B.V., Veldhoven (NL)

( * ) Notice: Subject to any disclaimer, the term of this patent is extended or adjusted under 35 U.S.C. 154(b) by 0 days.

(21) Appl. No.: 16/960,947

(22) PCT Filed: Jan. 3, 2019

(86) PCT No.: PCT/EP2019/050100
§ 371 (c)(1),
(2) Date: Jul. 9, 2020

(87) PCT Pub. No.: WO2019/137846
PCT Pub. Date: Jul. 18, 2019

(65) Prior Publication Data

US 2020/0344867 A1 Oct. 29, 2020

Related U.S. Application Data

(60) Provisional application No. 62/617,043, filed on Jan. 12, 2018.

(51) Int. Cl.
*H05G 2/00* (2006.01)

(52) U.S. Cl.
CPC ..... *H05G 2/006* (2013.01)

(58) Field of Classification Search
CPC ..... H05G 2/006
See application file for complete search history.

(56) References Cited

U.S. PATENT DOCUMENTS

2004/0066827 A1 4/2004 Steiger et al.
2009/0014688 A1 1/2009 Hoshino et al.
(Continued)

FOREIGN PATENT DOCUMENTS

WO 2014082811 A1 6/2014

OTHER PUBLICATIONS

Christopher Smith, European International Searching Authority, International Search Report and Written Opinion, corresponding PCT Application No. PCT/EP2019/050100, dated Mar. 21, 2019, 10 pages total.

*Primary Examiner* — Nicole M Ippolito
*Assistant Examiner* — Hanway Chang
(74) *Attorney, Agent, or Firm* — DiBerardino McGovern IP Group LLC

(57) ABSTRACT

Provided is an apparatus for and method of controlling formation of droplets (102*a, b*) used to generate EUV radiation that comprise an arrangement producing a laser beam directed to an irradiation region and a droplet source. The droplet source (92) includes a fluid exiting an nozzle (98) and a sub-system having an electro-actuatable element (104) producing a disturbance in the fluid (96). The droplet source produces a stream (100) that breaks down into droplets that in turn coalesce into larger droplets as they progress towards the irradiation region. The electro-actuatable element is driven by a hybrid waveform that controls the droplet generation/coalescence process. Also disclosed is a method of determining the transfer function for the nozzle.

18 Claims, 9 Drawing Sheets

(56) References Cited

U.S. PATENT DOCUMENTS

| | | | |
|---|---|---|---|
| 2011/0233429 | A1 | 9/2011 | Vaschenko |
| 2012/0286176 | A1 | 11/2012 | Rajyaguru et al. |
| 2014/0246607 | A1 | 9/2014 | Bykanov et al. |
| 2014/0284502 | A1 | 9/2014 | Nakano et al. |
| 2015/0293456 | A1 | 10/2015 | Dijksman et al. |

APPARATUS FOR AND METHOD OF CONTROLLING COALESCENCE OF DROPLETS IN A DROPLET STREAM

CROSS-REFERENCE TO RELATED APPLICATION

This application claims priority of U.S. application 62/617,043 which was filed on Jan. 12, 2018 and which is incorporated herein in its entirety by reference.

FIELD

The present application relates to extreme ultraviolet ("EUV") light sources and their methods of operation. These light sources provide EUV light by creating plasma from a source material. In one application, the EUV light may be collected and used in a photolithography process to produce semiconductor integrated circuits.

BACKGROUND

A patterned beam of EUV light can be used to expose a resist coated substrate, such as a silicon wafer, to produce extremely small features in the substrate. Extreme ultraviolet light (also sometimes referred to as soft x-rays) is generally defined as electromagnetic radiation having wavelengths in the range of about 5-100 nm. One particular wavelength of interest for photolithography occurs at 13.5 nm.

Methods to produce EUV light include, but are not necessarily limited to, converting a source material into a plasma state that has a chemical element with an emission line in the EUV range. These elements can include, but are not necessarily limited to, xenon, lithium and tin.

In one such method, often termed laser produced plasma ("LPP"), the desired plasma can be produced by irradiating a source material, for example, in the form of a droplet, stream or wire, with a laser beam. In another method, often termed discharge produced plasma ("DPP"), the required plasma can be generated by positioning source material having an appropriate emission line between a pair of electrodes and causing an electrical discharge to occur between the electrodes.

One technique for generating droplets involves melting a target material such as tin and then forcing it under high pressure through a relatively small diameter orifice, such as an orifice having a diameter of about 0.5 μm to about 30 μm, to produce a stream of droplets having droplet velocities in the range of about 30 m/s to about 150 m/s. Under most conditions, in a process called Rayleigh breakup, naturally occurring instabilities, e.g. noise, in the stream exiting the orifice, will cause the stream to break up into droplets. These droplets may have varying velocities and may combine with each other to coalesce into larger droplets.

In the EUV generation processes under consideration here, it is desirable to control the break up/coalescence process. For example, in order to synchronize the droplets with the optical pulses of an LPP drive laser, a repetitive disturbance with an amplitude exceeding that of the random noise may be applied to the continuous stream. By applying a disturbance at the same frequency (or its higher harmonics) as the repetition rate of the pulsed laser, the droplets can be synchronized with the laser pulses. For example, the disturbance may be applied to the stream by coupling an electro-actuatable element (such as a piezoelectric material) to the stream and driving the electro-actuatable element with a periodic waveform. In one embodiment, the electro-actuatable element will contract and expand in diameter (on the order of nanometers). This change in dimension is mechanically coupled to a capillary that undergoes a corresponding contraction and expansion of diameter. The column of target material. e.g., molten tin, inside the capillary also contracts and expands in diameter (and expands and contracts in length) to induce a velocity perturbation in the stream at the nozzle exit.

As used herein, the term "electro-actuatable element" and its derivatives, means a material or structure which undergoes a dimensional change when subjected to a voltage, electric field, magnetic field, or combinations thereof and includes, but is not limited to, piezoelectric materials, electrostrictive materials and magnetostrictive materials. Apparatus for and methods of using an electro-actuatable element to control a droplet stream are disclosed, for example, in U.S. Patent Application Publication No. 2009/0014668 A1, titled "Laser Produced Plasma EUV Light Source Having a Droplet Stream Produced Using a Modulated Disturbance Wave" and published Jan. 15, 2009, and U.S. Pat. No. 8,513,629, titled "Droplet Generator with Actuator Induced Nozzle Cleaning" and issued Aug. 20, 2013, both of which are hereby incorporated by reference in their entireties.

It is desired, however, not only to have droplets synchronized with the laser pulses, but also to have the droplets be coalesced into droplets larger than those initially created during breakup of the stream. It is also desired that this coalescence be effected under conditions that permit control of the coalescence process.

There is thus a need to be able to control droplet generation and coalescence in a manner that allows for optimization of these processes.

SUMMARY

The following presents a simplified summary of one or more embodiments in order to provide a basic understanding of the embodiments. This summary is not an extensive overview of all contemplated embodiments, and is not intended to identify key or critical elements of all embodiments nor delineate the scope of any or all embodiments. Its sole purpose is to present some concepts of one or more embodiments in a simplified form as a prelude to the more detailed description that is presented later.

According to one aspect there is disclosed an apparatus comprising a target material dispenser arranged to provide a stream of target material for a plasma generating system a stream of droplets of target material, an electro-actuatable element mechanically coupled to target material in the target material dispenser and arranged to induce velocity perturbations in the stream based on an amplitude of a control signal, and a waveform generator electrically coupled to the electro-actuatable element for supplying the control signal, the control signal comprising a hybrid waveform including a superposition of a first periodic waveform and a second periodic waveform. The waveform generator may include means to control a relative phase of the first periodic waveform and the second periodic waveform. The relative phase of the first periodic waveform with respect to the second periodic waveform may be controlled to determine a coalescence length of the stream of droplets of target material. A frequency of the second periodic waveform may be greater than the frequency of the first periodic waveform. A frequency of the second periodic waveform may be an integral multiple of a frequency of the first periodic waveform. The first periodic waveform may be a sine wave. The electro-actuatable element may be a piezoelectric element. The relative phase of the two periodic waveforms is such that droplets of target material in the stream of target material coalesce to a predetermined size within a predetermined coalescence length. The apparatus may further comprise a detector arranged to view the stream and to detect coalesced or uncoalesced target material in the stream.

According to another aspect there is disclosed a method comprising the steps of providing a stream of target material for a plasma generating system from a target material dispenser, generating a control signal comprising a hybrid waveform including a superposition of a first periodic waveform and a second periodic waveform, and applying the control signal to an electro-actuatable element mechanically coupled to the target material dispenser, the electro-actuatable element introducing a velocity perturbation on the stream at the exit of the target material dispenser. The frequency of the second periodic waveform may be greater than a frequency of the first periodic waveform. The frequency of the second periodic waveform may be an integral multiple of a frequency of the first periodic waveform. The electro-actuatable element may be a piezoelectric element. The relative phase of the first and second periodic waveforms is such that droplets of target material in the stream of target material coalesce to a predetermined size within a predetermined coalescence length.

According to another aspect there is disclosed a method of determining a transfer function of a droplet generator adapted to deliver a stream of liquid target material to an irradiation region in a system for generating EUV radiation, the method comprising the steps of providing the stream of target material for a plasma generating system from the droplet generator, generating a control signal comprising a hybrid waveform including a superposition of a first periodic waveform and a second periodic waveform, applying the control signal an electro-actuatable element mechanically coupled to the droplet generator to introduce a velocity perturbation into the stream, and determining a transfer function for the nozzle in response to the control signal based at least in part on a coalescence length of the stream, a velocity profile of the stream, and an amplitude of the first periodic waveform.

According to another aspect there is disclosed a method of determining a transfer function of a droplet generator adapted to deliver a stream of liquid target material to an irradiation region in a system for generating EUV radiation, the method comprising the steps of providing the stream of target material for a plasma generating system from the droplet generator, generating a control signal, the control signal comprising a hybrid waveform including a superposition of a first periodic waveform and a second periodic waveform, introducing a velocity perturbation into the stream by applying the control signal to an electro-actuatable element mechanically coupled to the droplet generator, reducing an amplitude of the first periodic waveform, observing the stream at a downstream point to determine whether droplets are fully coalesced, and determining a transfer function for the droplet generator in response to the control signal based on the amplitude of the first periodic waveform when droplets in the observed stream cease being fully coalesced.

According to another aspect there is disclosed a method of controlling a droplet generator adapted to deliver a stream of liquid target material to an irradiation region in a system for generating EUV radiation, the method comprising the steps of providing the stream of target material for a plasma generating system from the droplet generator, generating a control signal, the control signal comprising a hybrid waveform including a superposition of a first periodic waveform and a second periodic waveform, introducing a velocity perturbation into the stream by applying the control signal to an electro-actuatable element mechanically coupled to the droplet generator, and controlling a coalescence length of the stream by adjusting a relative phase of the second periodic waveform with respect to the first periodic waveform.

According to another aspect there is disclosed a method of controlling a droplet generator adapted to deliver a stream of liquid target material to an irradiation region in a system for generating EUV radiation, the method comprising the steps of providing the stream of target material for a plasma generating system from the droplet generator, generating a control signal, the control signal comprising a hybrid waveform including a superposition of a first periodic waveform having a first frequency and a second periodic waveform having a second frequency which is an integral multiple of the first frequency, introducing a velocity perturbation into the stream by applying the control signal to an electro-actuatable element mechanically coupled to the droplet generator, and controlling jitter of the stream by controlling an amplitude of the second periodic waveform.

According to another aspect there is disclosed a method of assessing a condition of a droplet generator adapted to deliver a stream of liquid target material to an irradiation region in a system for generating EUV radiation, the method comprising the steps of providing the stream of target material for a plasma generating system from the droplet generator, generating a control signal, the control signal comprising a hybrid waveform including a superposition of a first periodic waveform and a second periodic waveform, introducing a velocity perturbation into the stream by applying the control signal to an electro-actuatable element mechanically coupled to target material in the droplet generator, adjusting a relative phase of the second periodic waveform with respect to the first periodic waveform, observing the stream to determine whether coalescence occurs at the relative phase, repeating the adjusting step and the observing step to determine a range of relative phases at which coalescence occurs, assessing the condition of the droplet generator based on the determined range.

Further embodiments, features, and advantages of the present invention, as well as the structure and operation of the various embodiments are described in detail below with reference to accompanying drawings.

BRIEF DESCRIPTION OF THE DRAWINGS

The accompanying drawings, which are incorporated herein and form part of the specification, illustrate the methods and systems of embodiments of the invention by way of example, and not by way of limitation. Together with the detailed description, the drawings further serve to explain the principles of and to enable a person skilled in the relevant art(s) to make and use the methods and systems presented herein. In the drawings, like reference numbers indicate identical or functionally similar elements.

Figure 1:
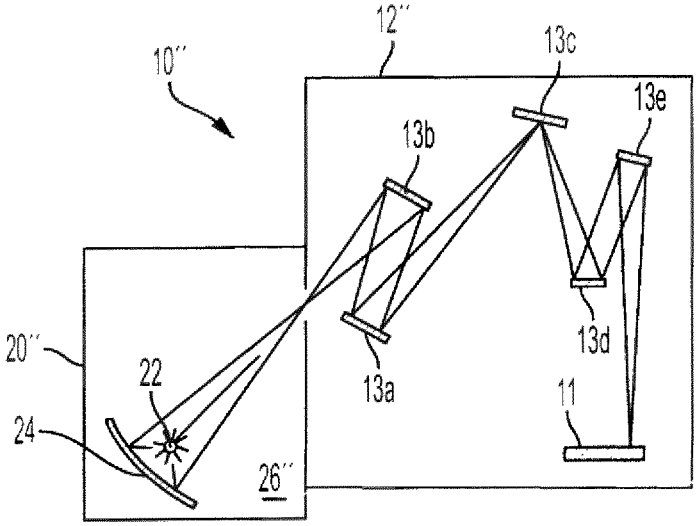
FIG. 1 is a simplified schematic view of an EUV light source coupled with an exposure device.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art based on the teachings contained herein.

DETAILED DESCRIPTION

Various embodiments are now described with reference to the drawings, wherein like reference numerals are used to refer to like elements throughout. In the following description, for purposes of explanation, numerous specific details are set forth in order to promote a thorough understanding of one or more embodiments. It may be evident in some or all instances, however, that any embodiment described below can be practiced without adopting the specific design details described below. In other instances, well-known structures and devices are shown in block diagram form in order to facilitate description of one or more embodiments. The following presents a simplified summary of one or more embodiments in order to provide a basic understanding of the embodiments. This summary is not an extensive overview of all contemplated embodiments, and is not intended to identify key or critical elements of all embodiments nor delineate the scope of any or all embodiments.

Before describing such embodiments in more detail, however, it is instructive to present an example environment in which embodiments of the present invention may be implemented. In the description that follows and in the claims the terms "up," "down," "top," "bottom," "vertical," "horizontal," and like terms may be employed. These terms are intended to show relative orientation only and not any orientation with respect to gravity.

With initial reference to FIG. 1, there is shown a simplified, schematic, sectional view of selected portions of one example of an EUV photolithography apparatus, generally designated 10". The apparatus 10" may be used, for example, to expose a substrate 11 such as a resist coated wafer with a patterned beam of EUV light. For the apparatus 10", an exposure device 12" utilizing EUV light, (e.g., an integrated circuit lithography tool such as a stepper, scanner, step and scan system, direct write system, device using a contact and/or proximity mask, etc.), may be provided having one or more optics 13 *a,b*, for example, to illuminate a patterning optic 13 *c* with a beam of EUV light, such as a reticle, to produce a patterned beam, and one or more reduction projection optic(s) 13 *d*, 13 *e*, for projecting the patterned beam onto the substrate 11. A mechanical assembly (not shown) may be provided for generating a controlled relative movement between the substrate 11 and patterning means 13 *c*. As further shown in FIG. 1, the apparatus 10" may include an EUV light source 20" including an EUV light radiator 22 emitting EUV light in a chamber 26" that is reflected by optic 24 along a path into the exposure device 12" to irradiate the substrate 11. The illumination system may include various types of optical components, such as refractive, reflective, electromagnetic, electrostatic or other types of optical components, or any combination thereof, for directing, shaping, or controlling radiation.

As used herein, the term "optic" and its derivatives is meant to be broadly construed to include, and not necessarily be limited to, one or more components which reflect and/or transmit and/or operate on incident light, and includes, but is not limited to, one or more lenses, windows, filters, wedges, prisms, grisms, gratings, transmission fibers, etalons, diffusers, homogenizers, detectors and other instrument components, apertures, axicons and mirrors including multi-layer mirrors, near-normal incidence mirrors, grazing incidence mirrors, specular reflectors, diffuse reflectors and combinations thereof. Moreover, unless otherwise specified, neither the term "optic" nor its derivatives, as used herein, are meant to be limited to components which operate solely or to advantage within one or more specific wavelength range(s) such as at the EUV output light wavelength, the irradiation laser wavelength, a wavelength suitable for metrology or any other specific wavelength.

Figure 1A:
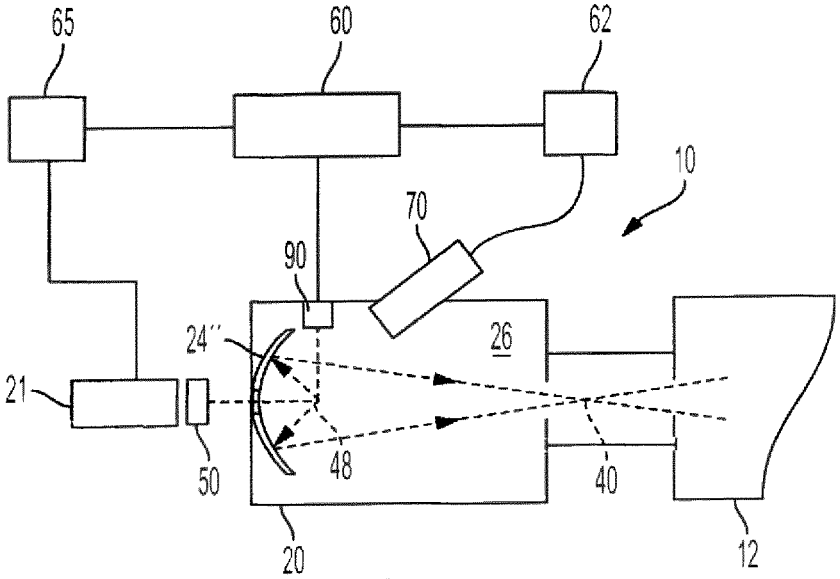
FIG. 1A is a simplified, schematic diagram of an apparatus including an EUV light source having an LPP EUV light radiator.

FIG. 1A illustrates a specific example of an apparatus 10 including an EUV light source 20 having an LPP EUV light radiator. As shown, the EUV light source 20 may include a system 21 for generating a train of light pulses and delivering the light pulses into a light source chamber 26. For the apparatus 10, the light pulses may travel along one or more beam paths from the system 21 and into the chamber 26 to illuminate source material at an irradiation region 48 to produce an EUV light output for substrate exposure in the exposure device 12.

Suitable lasers for use in the system 21 shown in FIG. 1A, may include a pulsed laser device, e.g., a pulsed gas discharge $CO_2$ laser device producing radiation at 9.3 μm or 10.6 μm, e.g., with DC or RF excitation, operating at relatively high power, e.g., 10 kW or higher and high pulse repetition rate, e.g., 50 kHz or more. In one particular implementation, the laser may be an axial-flow RF-pumped $CO_2$ laser having an oscillator-amplifier configuration (e.g., master oscillator/power amplifier (MOPA) or power oscillator/power amplifier (POPA)) with multiple stages of amplification and having a seed pulse that is initiated by a Q-switched oscillator with relatively low energy and high repetition rate, e.g., capable of 100 kHz operation. From the oscillator, the laser pulse may then be amplified, shaped and/or focused before reaching the irradiation region 48. Continuously pumped $CO_2$ amplifiers may be used for the laser system 21. Alternatively, the laser may be configured as a so-called "self-targeting" laser system in which the droplet serves as one mirror of the optical cavity.

Depending on the application, other types of lasers may also be suitable, e.g., an excimer or molecular fluorine laser operating at high power and high pulse repetition rate. Other examples include, a solid state laser, e.g., having a fiber, rod, slab, or disk-shaped active media, other laser architectures having one or more chambers, e.g., an oscillator chamber and one or more amplifying chambers (with the amplifying chambers in parallel or in series), a master oscillator/power oscillator (MOPO) arrangement, a master oscillator/power ring amplifier (MOPRA) arrangement, or a solid state laser that seeds one or more excimer, molecular fluorine or $CO_2$ amplifier or oscillator chambers, may be suitable. Other designs may be suitable.

In some instances, a source material may first be irradiated by a pre-pulse and thereafter irradiated by a main pulse. Pre-pulse and main pulse seeds may be generated by a single oscillator or two separate oscillators. In some setups, one or more common amplifiers may be used to amplify both the pre-pulse seed and main pulse seed. For other arrangements, separate amplifiers may be used to amplify the pre-pulse and main pulse seeds.

FIG. 1A also shows that the apparatus 10 may include a beam conditioning unit 50 having one or more optics for beam conditioning such as expanding, steering, and/or focusing the beam between the laser source system 21 and irradiation site 48. For example, a steering system, which may include one or more mirrors, prisms, lenses, etc., may be provided and arranged to steer the laser focal spot to different locations in the chamber 26. For example, the steering system may include a first flat mirror mounted on a tip-tilt actuator which may move the first mirror independently in two dimensions, and a second flat mirror mounted on a tip-tilt actuator which may move the second mirror independently in two dimensions. With this arrangement, the steering system may controllably move the focal spot in directions substantially orthogonal to the direction of beam propagation (beam axis).

The beam conditioning unit 50 may include a focusing assembly to focus the beam to the irradiation site 48 and adjust the position of the focal spot along the beam axis. For the focusing assembly, an optic, such as a focusing lens or mirror, may be used that is coupled to an actuator for movement in a direction along the beam axis to move the focal spot along the beam axis.

As further shown in FIG. 1A, the EUV light source 20 may also include a source material delivery system 90, e.g., delivering source material, such as tin droplets, into the interior of chamber 26 to an irradiation region 48, where the droplets will interact with light pulses from the system 21, to ultimately produce plasma and generate an EUV emission to expose a substrate such as a resist coated wafer in the exposure device 12. More details regarding various droplet dispenser configurations and their relative advantages may be found for example in U.S. Pat. No. 7,872,245, issued on Jan. 18, 2011, titled "Systems and Methods for Target Material Delivery in a Laser Produced Plasma EUV Light Source", U.S. Pat. No. 7,405,416, issued on Jul. 29, 2008, titled "Method and Apparatus For EUV Plasma Source Target Delivery", and U.S. Pat. No. 7,372,056, issued on May 13, 2008, titled "LPP EUV Plasma Source Material Target Delivery System", the contents of each of which are hereby incorporated by reference.

The source material for producing an EUV light output for substrate exposure may include, but is not necessarily limited to, a material that includes tin, lithium, xenon or combinations thereof. The EUV emitting element, e.g., tin, lithium, xenon, etc., may be in the form of liquid droplets and/or solid particles contained within liquid droplets. For example, the element tin may be used as pure tin, as a tin compound, e.g., $SnBr_4$, $SnBr_2$, $SnH_4$, as a tin alloy, e.g., tin-gallium alloys, tin-indium alloys, tin-indium-gallium alloys, or a combination thereof. Depending on the material used, the source material may be presented to the irradiation region at various temperatures including room temperature or near room temperature (e.g., tin alloys, $SnBr_4$), at an elevated temperature, (e.g., pure tin) or at temperatures below room temperature, (e.g., $SnH_4$), and in some cases, can be relatively volatile, e.g., $SnBr_4$.

Continuing with reference to FIG. 1A, the apparatus 10 may also include an EUV controller 60, which may also include a drive laser control system 65 for controlling devices in the system 21 to thereby generate light pulses for delivery into the chamber 26, and/or for controlling movement of optics in the beam conditioning unit 50. The apparatus 10 may also include a droplet position detection system which may include one or more droplet imagers 70 that provide an output indicative of the position of one or more droplets, e.g., relative to the irradiation region 48. The imager(s) 70 may provide this output to a droplet position detection feedback system 62, which can, e.g., compute a droplet position and trajectory, from which a droplet error can be computed, e.g., on a droplet-by-droplet basis, or on average. The droplet error may then be provided as an input to the controller 60, which can, for example, provide a position, direction and/or timing correction signal to the system 21 to control laser trigger timing and/or to control movement of optics in the beam conditioning unit 50, e.g., to change the location and/or focal power of the light pulses being delivered to the irradiation region 48 in the chamber 26. Also for the EUV light source 20, the source material delivery system 90 may have a control system operable in response to a signal (which in some implementations may include the droplet error described above, or some quantity derived therefrom) from the controller 60, to e.g., modify the release point, initial droplet stream direction, droplet release timing and/or droplet modulation to correct for errors in the droplets arriving at the desired irradiation region 48.

Continuing with FIG. 1A, the apparatus 10 may also include an optic 24" such as a near-normal incidence collector mirror having a reflective surface in the form of a prolate spheroid (i.e., an ellipse rotated about its major axis) having, e.g., a graded multi-layer coating with alternating layers of Molybdenum and Silicon, and in some cases, one or more high temperature diffusion barrier layers, smoothing layers, capping layers and/or etch stop layers. FIG. 1A shows that the optic 24" may be formed with an aperture to allow the light pulses generated by the system 21 to pass through and reach the irradiation region 48. As shown, the optic 24" may be, e.g., a prolate spheroid mirror that has a first focus within or near the irradiation region 48 and a second focus at a so-called intermediate region 40, where the EUV light may be output from the EUV light source 20 and input to an exposure device 12 utilizing EUV light, e.g., an integrated circuit lithography tool. It is to be appreciated that other optics may be used in place of the prolate spheroid mirror for collecting and directing light to an intermediate location for subsequent delivery to a device utilizing EUV light.

A buffer gas such as hydrogen, helium, argon or combinations thereof, may be introduced into, replenished and/or removed from the chamber 26. The buffer gas may be present in the chamber 26 during plasma discharge and may act to slow plasma created ions to reduce optic degradation and/or increase plasma efficiency. Alternatively, a magnetic field and/or electric field (not shown) may be used alone, or in combination with a buffer gas, to reduce fast ion damage.

Figure 2:
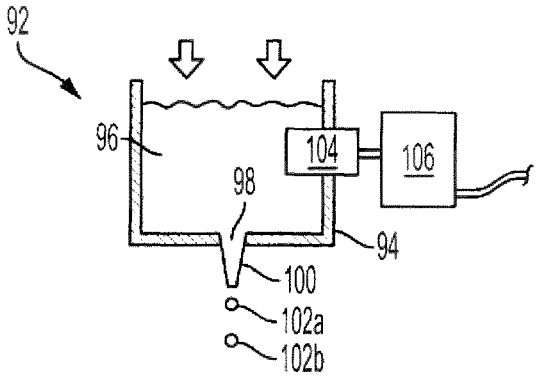
FIGS. 2, 2A-2C, 3, and 4 illustrate several different techniques for coupling one or more electro-actuatable element(s) with a fluid to create a disturbance in a stream exiting an orifice.
Figure 2A:
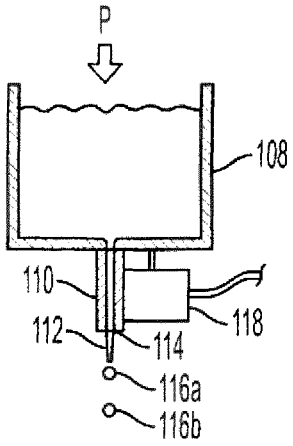

FIG. 2 illustrates the components of a simplified droplet source 92 in schematic format. As shown there, the droplet source 92 may include a reservoir 94 holding a fluid, e.g. molten tin, under pressure. Also shown, the reservoir 94 may be formed with an orifice 98 allowing the pressurized fluid 96 to flow through the orifice establishing a continuous stream 100 which subsequently breaks into a plurality of droplets 102 *a, b*.

Figure 2B:
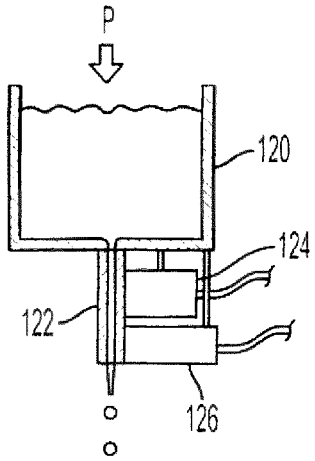
Figure 2C:
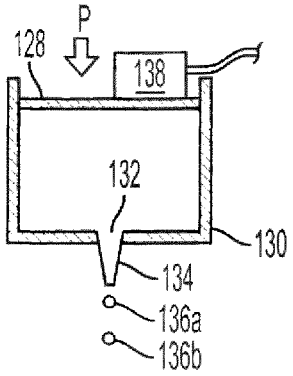

Continuing with FIG. 2, the droplet source 92 shown further includes a sub-system producing a disturbance in the fluid having an electro-actuatable element 104 that is operably coupled with the fluid 96 and a signal generator 106 driving the electro-actuatable element 104. FIGS. 2A-2C, 3 and 4 show various ways in which one or more electro-actuatable element(s) may be operably coupled with the fluid to create droplets. Beginning with FIG. 2A, an arrangement is shown in which the fluid is forced to flow from a reservoir 108 under pressure through a tube 110, e.g., capillary tube, having an inside diameter between about 0.5-0.8 mm, and a length of about 10 to 50 mm, creating a continuous stream 112 exiting an orifice 114 of the tube 110 which subsequently breaks up into droplets 116 *a,b*. As shown, an electro-actuatable element 118 may be coupled to the tube. For example, an electro-actuatable element may be coupled to the tube 110 to deflect the tube 110 and disturb the stream 112. FIG. 2B shows a similar arrangement having a reservoir 120, tube 122 and a pair of electro-actuatable elements 124, 126, each coupled to the tube 122 to deflect the tube 122 at a respective frequency. FIG. 2C shows another variation in which a plate 128 is positioned in a reservoir 130 moveable to force fluid through an orifice 132 to create a stream 134 which breaks into droplets 136 *a,b*. As shown, a force may be applied to the plate 128 and one or more electro-actuatable elements 138 may be coupled to the plate to disturb the stream 134. It is to be appreciated that a capillary tube may be used with the embodiment shown in FIG. 2C.

Figure 3:
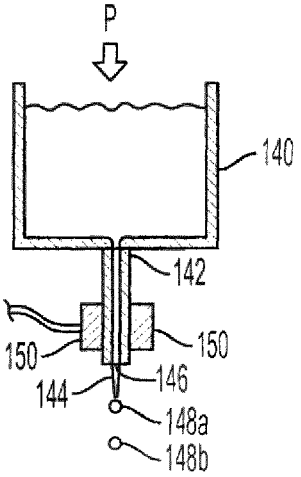

FIG. 3 shows another variation, in which a fluid is forced to flow from a reservoir 140 under pressure through a tube 142 creating a continuous stream 144, exiting an orifice 146 of the tube 142, which subsequently breaks-up into droplets 148 *a,b*. As shown, an electro-actuatable element 150, e.g., having a ring-shape or cylindrical tube shape, may be positioned to surround a circumference of the tube 142. When driven, the electro-actuatable element 150 may selectively squeeze and/or un-squeeze the tube 142 to disturb the stream 144. It is to be appreciated that two or more electro-actuatable elements may be employed to selectively squeeze the tube 142 at respective frequencies.

Figure 4:
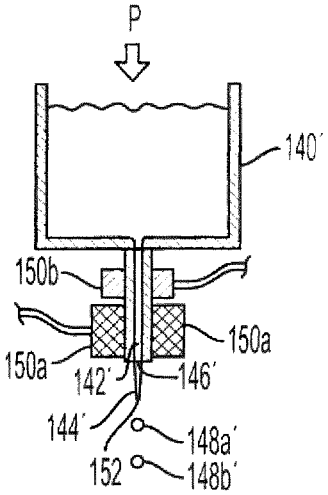

FIG. 4 shows another variation, in which a fluid is forced to flow from a reservoir 140' under pressure through a tube 142' creating a continuous stream 144', exiting an orifice 146' of the tube 142', which subsequently breaks-up into droplets 148*a',b'*. As shown, an electro-actuatable element 150*a*, e.g., having a ring-shape, may be positioned to surround a circumference of the tube 142'. When driven, the electro-actuatable element 150*a* may selectively squeeze the tube 142' to disturb the stream 144' and produce droplets. FIG. 4 also shows that a second electro-actuatable element 150*b*, e.g. having a ring-shape, may be positioned to surround a circumference of the tube 142'. When driven, the electro-actuatable element 150*b* may selectively squeeze the tube 142' to disturb the stream 144' and dislodge contaminants from the orifice 152. For the embodiment shown, electro-actuatable elements 150*a* and 150*b* may be driven by the same signal generator or different signal generators may be used. As described further below, waveforms having different waveform amplitude, periodic frequency and/or waveform shape may be used to drive electro-actuatable element 150*a* to produce droplets for EUV output. The electro-actuatable element produces a disturbance in the fluid which generates droplets having differing initial velocities causing at least some adjacent droplet pairs to coalesce together prior to reaching the irradiation region. The ratio of initial droplets to coalesced droplets may be two, three or more and in some cases tens, hundreds, or more.

Control of the breakup/coalescence process thus involves controlling the droplets such that they coalesce sufficiently before reaching the irradiation region and have a frequency corresponding to the pulse rate of the laser being used to irradiate the coalesced droplets. According to one aspect of an embodiment, a hybrid waveform made up of multiple voltage waveforms is supplied to electro-actuatable element to control the coalescence process of Rayleigh breakup micro droplets into fully coalesced droplets of a frequency corresponding to the laser pulse rate. The waveform may be defined as a voltage or current signal. According to another aspect, the on-axis droplet velocity profile is obtained by imaging the droplet stream at fixed location downstream of coalescence and used as feedback to control the droplet generation/coalescence process. As a form of imaging, it is possible to use a light barrier to resolve droplet passage in time and reconstruct the droplet coalescence pattern from this information.

The use of the hybrid waveform enables a user to target a specific droplet coalescence length at a user specified frequency using feedback from imaging metrology at a fixed point downstream of the fully coalesced droplet. One form of hybrid waveform may be comprised of (1) a sine wave at a fundamental frequency that is substantially equal to the laser pulse rate and (2) a higher frequency periodic waveform. The higher frequency is a multiple of the fundamental frequency. Use of the hybrid waveform process also permits nozzle transfer function determinations of the on-axis target material stream velocity perturbations/profile which in turn can be used to optimize the parameters of the hybrid waveform driving the electro-actuatable element.

Figure 5:
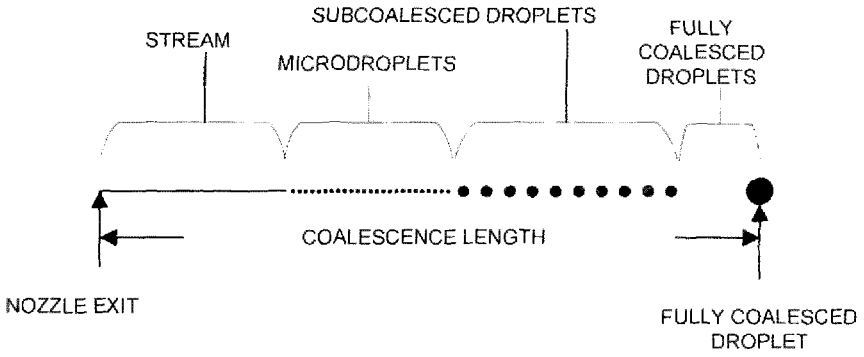
FIG. 5 is a diagram illustrating states of coalescence in a droplet stream.

The use of the hybrid waveform process decomposes the overall droplet coalescence process into a succession of multiple subcoalescence steps or regimes evolving as a function of distance from the nozzle. This is shown in FIG. 5. For example, in a first regime, that is, when the target material first exits the nozzle, the target material is in the form of a velocity-perturbed steady stream. In a second regime, the stream breaks up into a series of microdroplets having varying velocities. In the third regime, measured either in time of flight or by distance from the nozzle, the microdroplets coalesce into droplets of an intermediate size, referred to as subcoalesced droplets, having varying velocities with respect to one another. In the fourth regime the subcoalesced droplets coalesce into droplets having the desired final size. The number of subcoalescence steps can vary. The distance from the nozzle to the point at which the droplets reach their final coalesced state is the coalescence distance.

Figure 6:
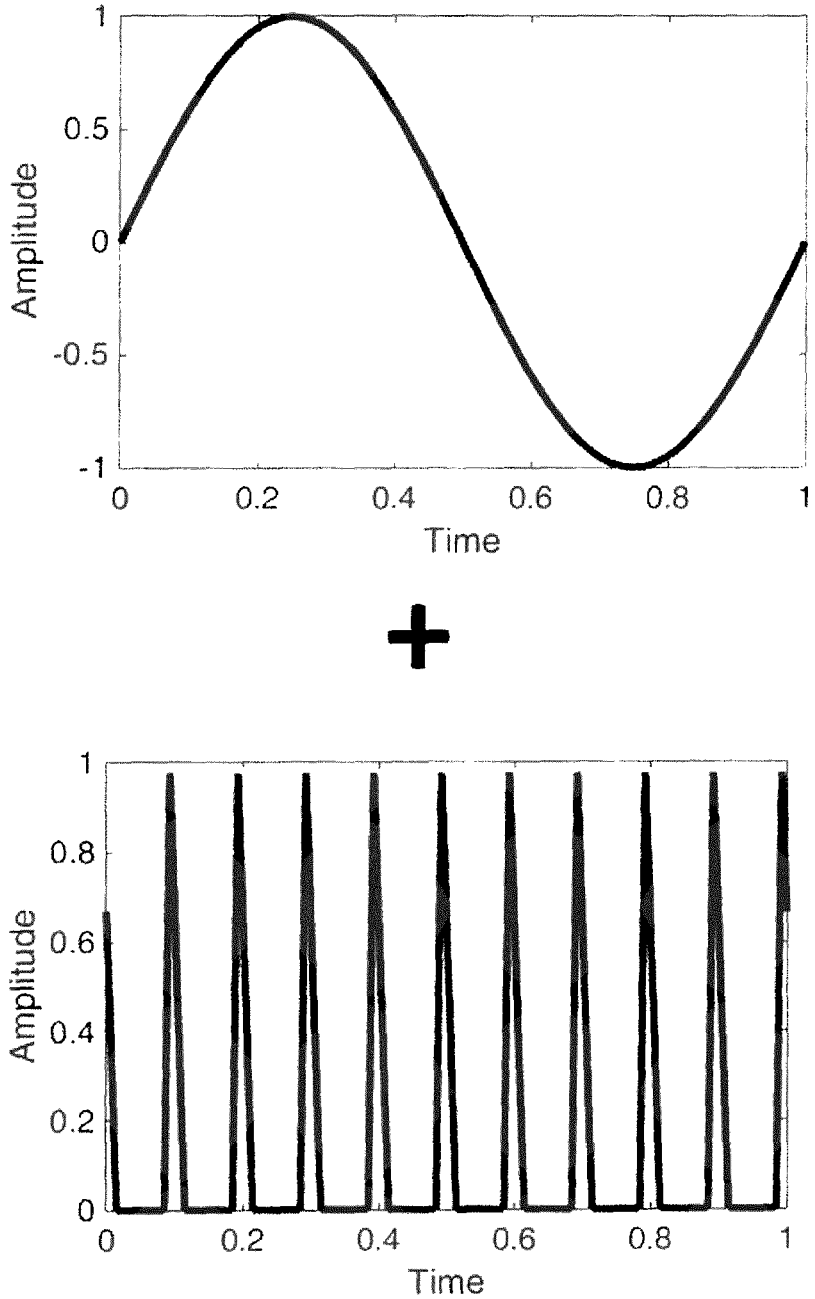
FIG. 6 is a graph of a hybrid waveform such as may be used according to one aspect of an embodiment.

Some characteristics of an example of a hybrid waveform will now be explained in conjunction with FIG. 6. The upper waveform in FIG. 6 is the fundamental waveform that will in general have a frequency the same as or otherwise related to the pulse rate of the laser used to vaporize the droplets. Any periodic wave can be used; in the example the fundamental waveform is a sine wave. The lower waveform in FIG. 6 is the higher frequency waveform that will in general have a frequency that is an integral multiple of the frequency of the fundamental waveform. Any arbitrary periodic wave can be used; in the example the higher frequency waveform is a series of triangular spikes. These two waveforms are superposed to obtain the hybrid waveform.

Figure 6A:
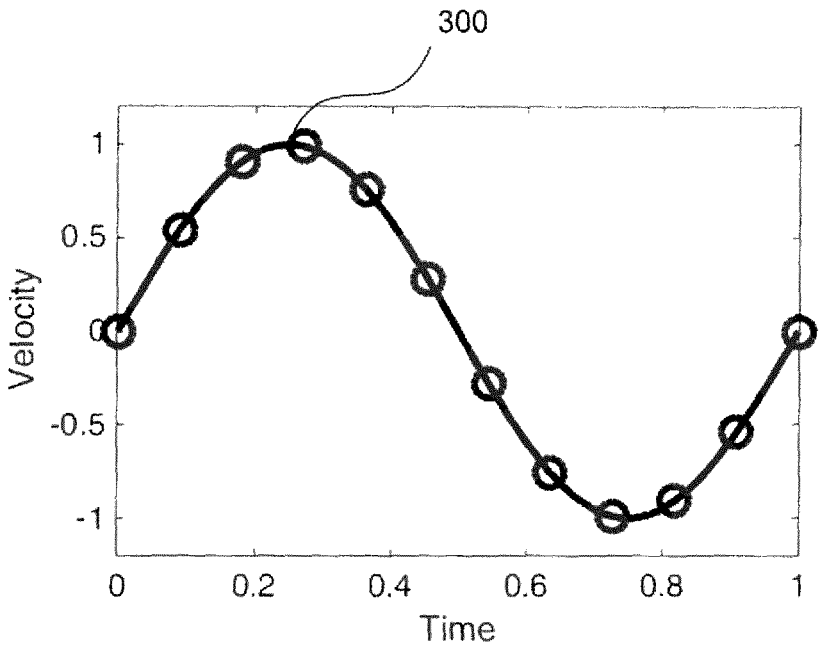
FIG. 6A are diagrams showing a relationship between velocity and coalescence.
Figure 6A:
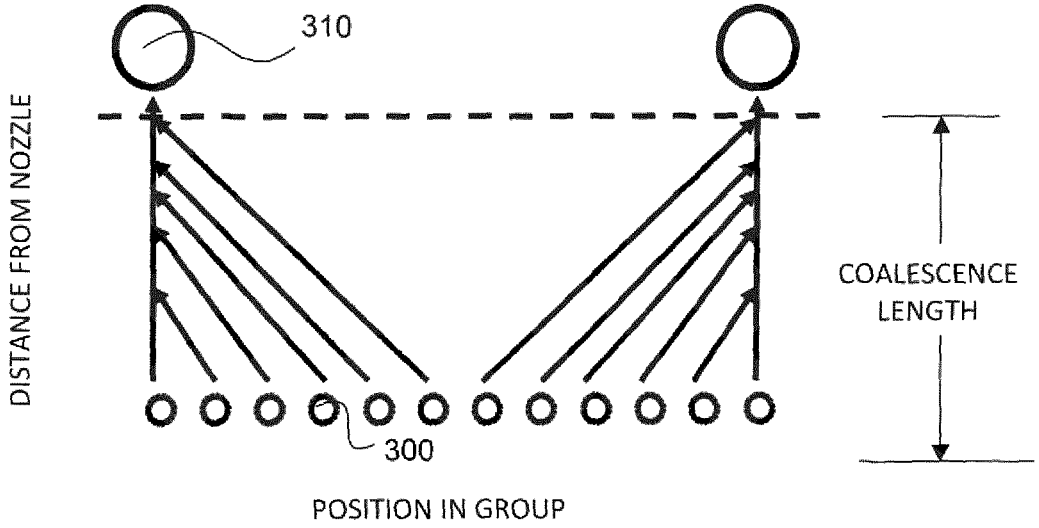

The combination (superposition) of the low frequency sine wave and higher frequency periodic waveform, which are both components of the hybrid wave, can achieve full coalescence of the droplets. This is shown in FIG. 6A which shows the effect of applying a hybrid waveform such as that just described to the electro-actuatable element. The top graph in FIG. 6A shows a resulting velocity distribution for droplets being released by the nozzle under the influence of the electro-actuatable element over one period of application of the fundamental wave. The lower graph of FIG. 6A is a coalescence pattern for droplets being released by the nozzle under the influence of the electro-actuatable element. The x-axis of the bottom graph is position within a group of droplets. A group is the collection of droplets released during one period of the driving voltage. The y-axis is the distance from the nozzle. Because of the velocity variation faster droplets such as subcoalesced droplet 300 will catch up to, and coalesce with, earlier, slower droplets to form fully coalesced droplets 310; while slower droplets will be caught up to by later, faster droplets. It will be understood that the subcoalesced droplets themselves as the result of a preliminary coalescence of microdroplets, not shown in the figure. If some of the droplets do not converge on the main droplet then there are "satellite" droplets and full coalescence is not achieved.

A hybrid waveform, which includes a low frequency sine wave and a higher order arbitrary periodic waveform, could be first used to subcoalesce droplets at an intermediate sine frequency $f_1$. In a second step, another hybrid waveform could be employed to achieve the main coalescence at a lower frequency $f_2$ that may match the laser pulse rate. When combined with a lower sine frequency $f_2$, the hybrid waveform with the sine frequency $f_1$ can be considered to be the high frequency arbitrary waveform of the hybrid waveform that gives coalescence at a lower frequency $f_2$. This process of staggering waveforms could be repeated multiple times.

Figure 7:
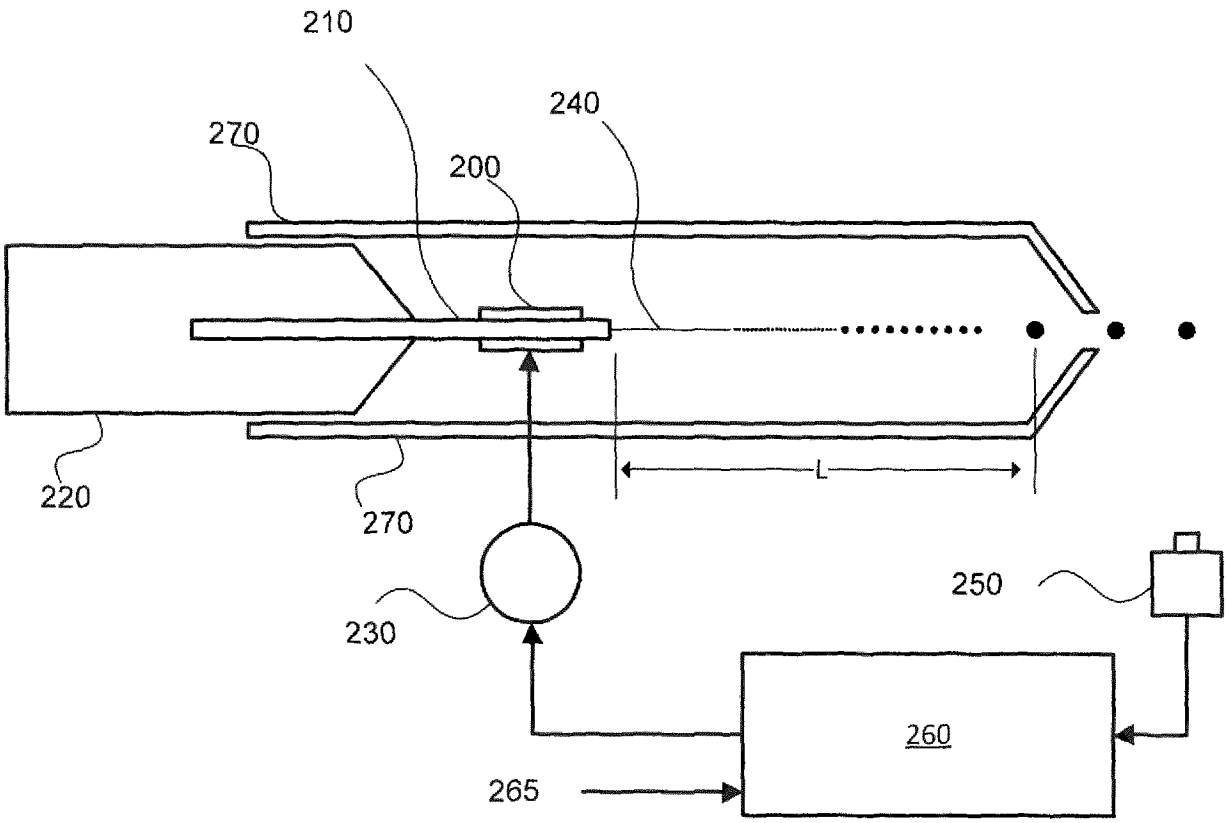
FIG. 7 is a diagram of a droplet generation system with feedback such as may be used according to one aspect of an embodiment.

Referring now to FIG. 7, there is shown an electro-actuatable element 200 positioned around a capillary 210 of a nozzle 220. The electro-actuatable element 200 transduces electrical energy from the hybrid waveform generator 230 to apply varying pressure to a capillary 210. This introduces a velocity perturbation in the stream 240 of molten target material 240 exiting the nozzle 220. The target material ultimately coalesces into droplets which are imaged by a camera 250. Imaged herein encompasses both forming an image of the droplet as well as a mere binary indication of the presence or absence of a droplet. The imaging develops a velocity profile of the droplet stream at the imaging point. A control unit 260 uses the imaging data from the camera 250 to generate a feedback signal to control operation of the hybrid wave generator 230. The control means 260 also controls the relative phase of the low frequency periodic wave and the higher order arbitrary periodic waveform as well as the amplitude of the low frequency periodic wave and the amplitude of the higher order arbitrary periodic waveform based on a control input 265 which may originate from another controller or be based on a user input. As explained in more detail below, the relative phase of the low frequency periodic wave and the higher order arbitrary periodic waveform may be adjusted to control coalescence length, the amplitude of the low frequency periodic wave may be adjusted to control droplet coalescence, and the amplitude of the higher order arbitrary periodic waveform may be adjusted to control droplet velocity jitter.

Also shown in FIG. 7 is a shroud 270 positioned around the target material stream in the vacuum chamber to protect the target material stream within the chamber. It will be understood that the shroud 270 is shown as a reference location only and that the apparatus disclosed herein need not include a shroud, nor do the methods disclosed herein require the use of a shroud.

Figure 8:
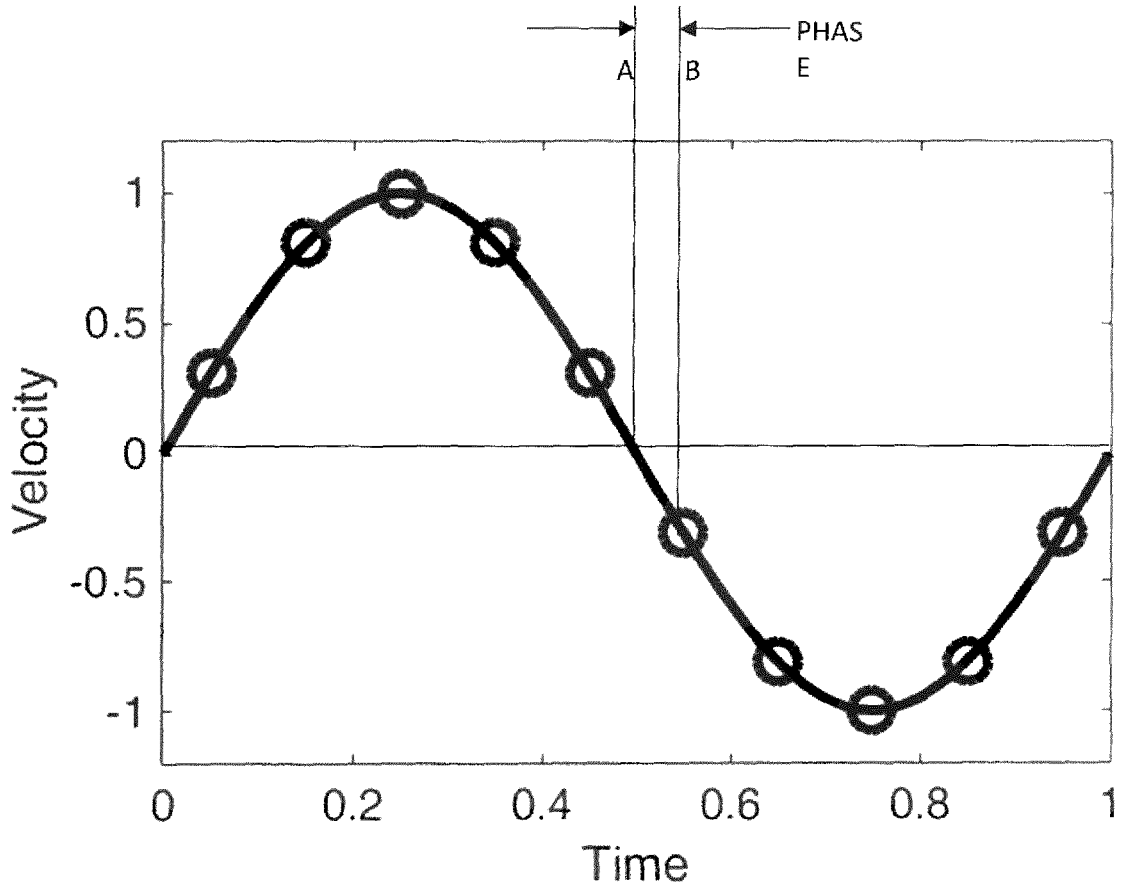
FIG. 8 is a diagram illustrating a possible conceptualization of phase as it may be applied to one aspect of an embodiment.

The relative phase between the low frequency sine wave and high frequency periodic waveform that are included in the hybrid waveform for which the coalescence process is successful (i.e., coalesces the droplets within a desired coalescence length) provides a method to measure the nozzle transfer function at the fundamental frequency of the system. One possible conceptualization of relative phase in this context is illustrated in FIG. 8. Here, phase determines the position of subcoalesced droplets with respect to the low frequency sine. Using the time when the low frequency sine crosses zero as indicated by line A as a reference, phase can be considered as the interval between this reference and the occurrence of subcoalesced droplet as indicated by B in the figure. The phase shown in FIG. 8 may be one that results in successful coalescence in which case coalescence such as that shown in the lower graph in FIG. 6A is achieved. Phase of a different magnitude may not result in successful coalescence leading to a stream with droplets of various sizes.

Figure 9:
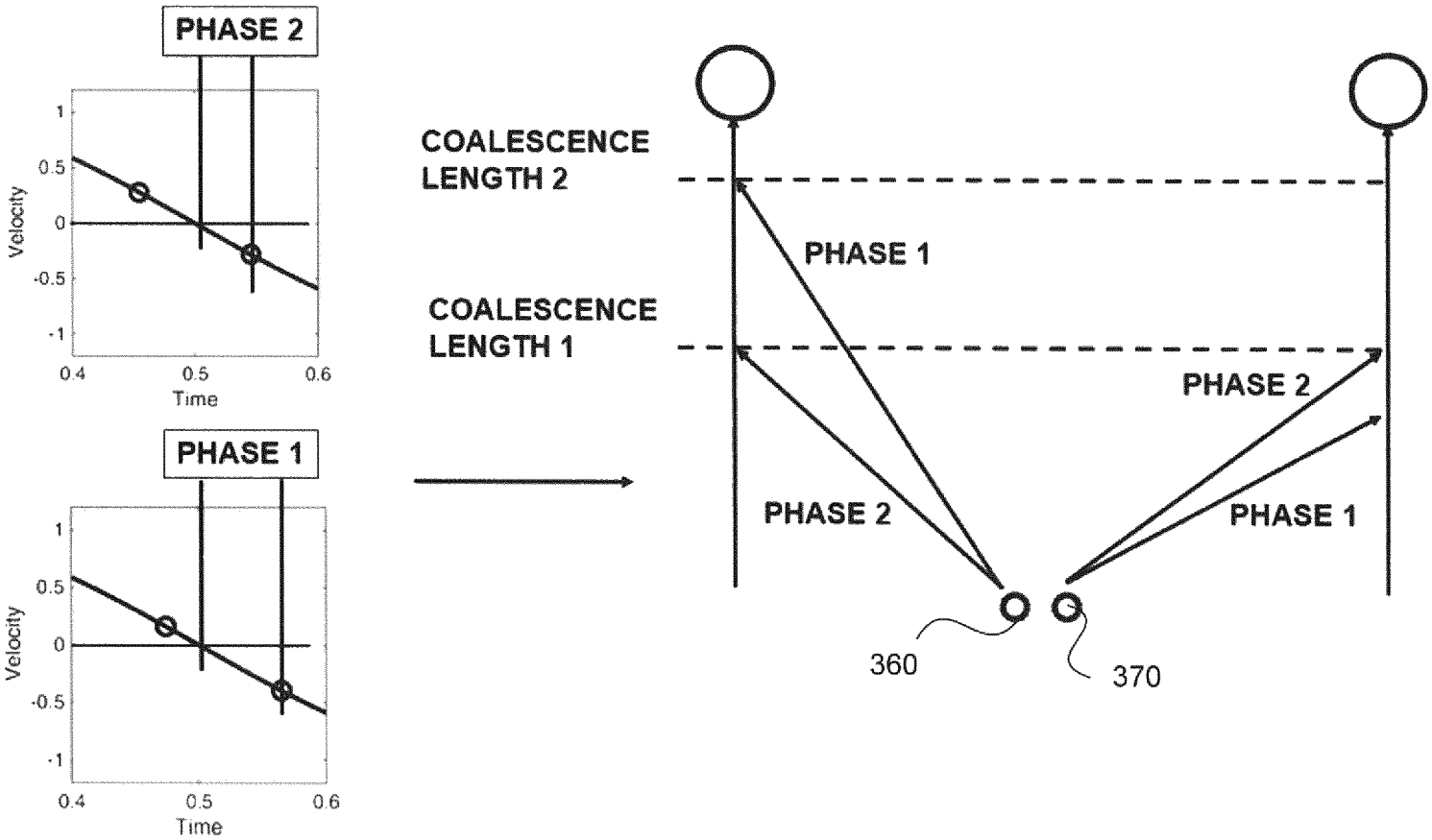
FIG. 9 is a diagram showing possible effect of relative phase on coalescence.

Phase also influences coalescence length. This is shown on FIG. 9. The graphs on the left of FIG. 9 show phase as described above. At phase 2 the subcoalesced droplets 360 and 370 in the diagram on the right hand side of the figure coalesce at a coalescence length 1 whereas at phase 1 they coalesce at a coalescence length 2 which is greater than coalescence length 1.

The range of phase differences for which coalescence can be achieved can be regarded as a phase margin. The magnitude of the phase margin can be used to assess the condition of the droplet generator. For example, a change in the size of the phase margin exceeding a predetermined threshold could be used as an indication that the droplet generator requires maintenance or is reaching the end of its useful life.

The nozzle transfer function may be defined as the velocity perturbation that is obtained at the nozzle exit per unit applied voltage at a specific frequency. For the considered nozzle transfer function, the signal applied to the electro-actuatable element (characterized by frequency, magnitude, and phase) is the input, while the velocity perturbation as imposed on the liquid jet is the output. Coalescence length varies with the amplitude of the sine component of the hybrid waveform. Larger sine amplitude implies an increased velocity perturbation, hence coalescence length decreases.

The transfer function determination can be corroborated in-situ by reducing the amplitude of the low frequency sine wave component of the hybrid waveform voltage until the coalescence process breaks down. At a fixed location, metrology needs to be used to detect when the droplet coalescence to the low frequency fails. At this point the transfer function can be determined using a simple time of flight calculation between the nozzle exit and location of fixed metrology point. Accuracy of this method is predicated on the successful realization of higher frequency subcoalescence droplets. The method can be repeated to determine the transfer function calculation for any given pair of frequencies as long as the frequency of the higher waveform component is an integral multiple of the frequency of the lower frequency sine wave component. This transfer function may then be used in a feedback loop to optimize the applied voltage amplitude into the electro-actuatable element. The transfer function can also be used as a performance indicator for the droplet generator. The optimization would typically aim at tuning coalescence length to a specific requirement. In a LPP source, coalescence should be completed outside the irradiation region. The magnitude of the transfer function may be determined, according to the relationship $$|TF(f_0)| = \frac{u^2}{2l_c V f_0}\varphi$$

where $|TF(f_0)|$ is the transfer function magnitude at a fundamental frequency $f_0$, u is the droplet stream velocity as determined by imaging the stream, $l_c$ is the coalescence length, V is the voltage amplitude of the sine wave component at the coalescence length, f is the droplet frequency, and φ is a discretionary correction factor. Again, the transfer function can be used to assess the condition of the droplet generator. For example, a change in the transfer function could be used as an indication that the droplet generator requires maintenance or is reaching the end of its useful life.

Thus, according to one aspect, an embodiment involves decomposing droplet coalescence into one or more subcoalescence steps with metrology feedback. An embodiment also involves measuring the nozzle transfer function using the relative phase margin between a high and low frequency piezoelectric excitation signal at a fixed metrology point. For a specific range of values for the phase in question, droplet coalescence to the lower frequency can be achieved. This information about the available phase margin can be used to derive the coalescence length. The relationship between phase margin and the resulting coalescence length is given by:

$$l_c = l_{metrology} * \left(\cos\left(\frac{PM}{2*N}\right) - \cos\left(2*\frac{\pi}{N} - \frac{PM}{2*N}\right)\right) \Big/ (1 - \cos(2*\pi/N))$$

where $l_c$ is the coalescence length, $l_{metrology}$ is the distance of the metrology from the nozzle, PM is the phase margin and N is the frequency multiplier for the high frequency arbitrary waveform with respect to the low frequency sine wave. The center of the phase region with coalesced droplets gives minimum coalescence.

The hybrid waveform may be characterized by several parameters. The exact number of parameters depends on the choice of the higher frequency arbitrary periodic waveform that could have several tuning parameters. Sine voltage, voltage of the higher frequency waveform and relative phase would in general be included among the characterizing parameters. While sine voltage and phase determine coalescence length, as presented above, the voltage of the higher frequency arbitrary periodic waveform controls the velocity jitter of the low frequency droplets. Velocity jitter of droplets results in variations of droplet timing. Typically, droplet timing must be limited in order to enable synchronization of the droplets with the laser pulse.

An embodiment also involves targeting the droplet coalescence length using metrology at a fixed location downstream of the fully coalesced droplet. An embodiment also involves independently optimizing coalescence length and main droplet jitter, that is, repeatability of droplet timing and position.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance. The breadth and scope of the present invention should not be limited by any of the above-described exemplary embodiments, but should be defined only in accordance with the following claims and their equivalents.

Other aspects of the invention are set out in the following numbered clauses.

1. Apparatus comprising:

a target material dispenser arranged to provide a stream of droplets of target material for a plasma generating system;

an electro-actuatable element mechanically coupled to target material in the target material dispenser and arranged to induce velocity perturbations in the stream based on an amplitude of a control signal; and a waveform generator electrically coupled to the electro-actuatable element for supplying the control signal, the control signal comprising a hybrid waveform including a superposition of a first periodic waveform and a second periodic waveform.

2. Apparatus as in clause 1 wherein the waveform generator includes means to control a relative phase of the first periodic waveform and the second periodic waveform.

3. Apparatus as in clause 2 wherein the relative phase of the first periodic waveform with respect to the second periodic waveform is controlled to determine a coalescence length of the stream of droplets of target material.

4. Apparatus as in clause 1 wherein a frequency of the second periodic waveform is greater than the frequency of the first periodic waveform.

5. Apparatus as in clause 1 wherein a frequency of the second periodic is an integral multiple of a frequency of the first periodic waveform.

6. Apparatus as in clause 1 wherein the first periodic waveform is a sine wave.

7. Apparatus as in clause 1 wherein the electro-actuatable element is a piezoelectric element.

8. Apparatus as in clause 1 wherein a relative phase of the first periodic waveform and the second periodic waveform is such that droplets of target material in the stream of target material coalesce to a predetermined size within a predetermined coalescence length.

9. Apparatus as in clause 1 further comprising a detector arranged to view the stream and to detect coalesced or uncoalesced target material in the stream.

10. A method comprising the steps of:

providing a stream of target material for a plasma generating system from a target material dispenser;

generating a control signal comprising a hybrid waveform including a superposition of a first periodic waveform and a second periodic waveform; and applying the control signal to an electro-actuatable element mechanically coupled to the target material dispenser, the electro-actuatable element introducing a velocity perturbation on the stream at the exit of the target material dispenser.

11. A method as in clause 10 wherein a frequency of the second periodic waveform is greater than a frequency of the first periodic waveform.

12. A method as in clause 10 wherein a frequency of the second periodic waveform is an integral multiple of a frequency of the first periodic waveform.

13. A method as in clause 10 wherein the electro-actuatable element is a piezoelectric element.

14. A method as in clause 10 wherein a relative phase of the first and second periodic waveforms is such that droplets of target material in the stream of target material coalesce to a predetermined size within a predetermined coalescence length.

15. A method of determining a transfer function of a droplet generator adapted to deliver a stream of liquid target material to an irradiation region in a system for generating EUV radiation, the method comprising the steps of:

providing the stream of liquid target material for a plasma generating system from the droplet generator;

generating a control signal comprising a hybrid waveform including a superposition of a first periodic waveform and a second periodic waveform;

applying the control signal an electro-actuatable element mechanically coupled to the droplet generator to introduce a velocity perturbation into the stream; and determining a transfer function for the nozzle in response to the control signal based at least in part on a coalescence length of the stream, a velocity profile of the stream, and an amplitude of the first periodic waveform.

16. A method of determining a transfer function of a droplet generator adapted to deliver a stream of liquid target material to an irradiation region in a system for generating EUV radiation, the method comprising the steps of:

providing the stream of liquid target material for a plasma generating system from the droplet generator;

generating a control signal, the control signal comprising a hybrid waveform including a superposition of a first periodic waveform and a second periodic waveform;

introducing a velocity perturbation into the stream by applying the control signal to an electro-actuatable element mechanically coupled to the droplet generator;

reducing an amplitude of the first periodic waveform;

observing the stream at a downstream point to determine whether droplets are fully coalesced; and determining a transfer function for the droplet generator in response to the control signal based on the amplitude of the first periodic waveform when droplets in the observed stream cease being fully coalesced.

17. A method of controlling a droplet generator adapted to deliver a stream of liquid target material to an irradiation region in a system for generating EUV radiation, the method comprising the steps of:

providing the stream of liquid target material for a plasma generating system from the droplet generator;

generating a control signal, the control signal comprising a hybrid waveform including a superposition of a first periodic waveform and a second periodic waveform;

introducing a velocity perturbation into the stream by applying the control signal to an electro-actuatable element mechanically coupled to the droplet generator; and controlling a coalescence length of the stream by adjusting a relative phase of the second periodic waveform with respect to the first periodic waveform.

18. A method of controlling a droplet generator adapted to deliver a stream of liquid target material to an irradiation region in a system for generating EUV radiation, the method comprising the steps of:

providing the stream of liquid target material for a plasma generating system from the droplet generator;

generating a control signal, the control signal comprising a hybrid waveform including a superposition of a first periodic waveform having a first frequency and a second periodic waveform having a second frequency which is an integral multiple of the first frequency;

introducing a velocity perturbation into the stream by applying the control signal to an electro-actuatable element mechanically coupled to the droplet generator; and controlling jitter of the stream by controlling an amplitude of the second periodic waveform.

19. A method of assessing a condition of a droplet generator adapted to deliver a stream of liquid target material to an irradiation region in a system for generating EUV radiation, the method comprising the steps of:

providing the stream of liquid target material for a plasma generating system from the droplet generator;

generating a control signal, the control signal comprising a hybrid waveform including a superposition of a first periodic waveform and a second periodic waveform;

introducing a velocity perturbation into the stream by applying the control signal to an electro-actuatable element mechanically coupled to target material in the droplet generator;

adjusting a relative phase of the second periodic waveform with respect to the first periodic waveform;

observing the stream to determine whether coalescence occurs at the relative phase; repeating the adjusting step and the observing step to determine a range of relative phases at which coalescence occurs;

assessing the condition of the droplet generator based on the determined range.

What is claimed is:

1. Apparatus comprising:

a target material dispenser arranged to provide a stream of droplets of target material for a plasma generating system;

an electro-actuatable element mechanically coupled to target material in the target material dispenser and arranged to induce velocity perturbations in the stream based on an amplitude of a control signal; and a waveform generator electrically coupled to the electro-actuatable element for supplying the control signal, the control signal comprising a hybrid waveform including a superposition of a first periodic waveform and a second periodic waveform, the waveform generator including means to control a relative phase of the first periodic waveform and the second periodic waveform.

2. Apparatus as in claim 1 wherein the relative phase of the first periodic waveform with respect to the second periodic waveform is controlled to determine a coalescence length of the stream of droplets of target material.

3. Apparatus as in claim 1 wherein a frequency of the second periodic waveform is greater than the frequency of the first periodic waveform.

4. Apparatus as in claim 1 wherein a frequency of the second periodic waveform is an integral multiple of a frequency of the first periodic waveform.

5. Apparatus as in claim 1 wherein the first periodic waveform is a sine wave.

6. Apparatus as in claim 1 wherein the electro-actuatable element is a piezoelectric element.

7. Apparatus as in claim 1 wherein a relative phase of the first periodic waveform and the second periodic waveform is such that droplets of target material in the stream of droplets of target material coalesce to a predetermined size within a predetermined coalescence length.

8. Apparatus as in claim 1 further comprising a detector arranged to view the stream and to detect coalesced or uncoalesced target material in the stream.

9. A method comprising the steps of:

providing a stream of droplets of target material for a plasma generating system from a target material dispenser;

generating a control signal comprising a hybrid waveform including a superposition of a first periodic waveform and a second periodic waveform and controlling a relative phase of the first periodic waveform and the second periodic waveform; and applying the control signal to an electro-actuatable element mechanically coupled to the target material dispenser, the electro-actuatable element introducing a velocity perturbation on the stream at the exit of the target material dispenser.

10. The method as in claim 9 wherein a frequency of the second periodic waveform is greater than a frequency of the first periodic waveform.

11. The method as in claim 9 wherein a frequency of the second periodic waveform is an integral multiple of a frequency of the first periodic waveform.

12. The method as in claim 9 wherein the electro-actuatable element is a piezoelectric element.

13. The method as in claim 9 wherein a relative phase of the first and second periodic waveforms is such that droplets of target material in the stream of droplets of target material coalesce to a predetermined size within a predetermined coalescence length.

14. A method of determining a transfer function of a droplet generator adapted to deliver a stream of liquid target material to an irradiation region in a system for generating EUV radiation, the method comprising the steps of:

providing the stream of liquid target material for a plasma generating system from the droplet generator;

generating a control signal comprising a hybrid waveform including a superposition of a first periodic waveform and a second periodic waveform;

applying the control signal to an electro-actuatable element mechanically coupled to the droplet generator to introduce a velocity perturbation into the stream; and determining a transfer function for the nozzle in response to the control signal based at least in part on a coalescence length of the stream, a velocity profile of the stream, and an amplitude of the first periodic waveform.

15. A method of determining a transfer function of a droplet generator adapted to deliver a stream of liquid target material to an irradiation region in a system for generating EUV radiation, the method comprising the steps of:

providing the stream of liquid target material for a plasma generating system from the droplet generator;

generating a control signal, the control signal comprising a hybrid waveform including a superposition of a first periodic waveform and a second periodic waveform;

introducing a velocity perturbation into the stream by applying the control signal to an electro-actuatable element mechanically coupled to the droplet generator;

reducing an amplitude of the first periodic waveform;

observing the stream at a downstream point to determine whether droplets are fully coalesced; and determining a transfer function for the droplet generator in response to the control signal based on the amplitude of the first periodic waveform when droplets in the observed stream cease being fully coalesced.

16. A method of controlling a droplet generator adapted to deliver a stream of liquid target material to an irradiation region in a system for generating EUV radiation, the method comprising the steps of:

providing the stream of liquid target material for a plasma generating system from the droplet generator;

generating a control signal, the control signal comprising a hybrid waveform including a superposition of a first periodic waveform and a second periodic waveform;

introducing a velocity perturbation into the stream by applying the control signal to an electro-actuatable element mechanically coupled to the droplet generator; and controlling a coalescence length of the stream by adjusting a relative phase of the second periodic waveform with respect to the first periodic waveform.

17. A method of controlling a droplet generator adapted to deliver a stream of liquid target material to an irradiation region in a system for generating EUV radiation, the method comprising the steps of:

providing the stream of liquid target material for a plasma generating system from the droplet generator;

generating a control signal, the control signal comprising a hybrid waveform including a superposition of a first periodic waveform having a first frequency and a second periodic waveform having a second frequency which is an integral multiple of the first frequency;

introducing a velocity perturbation into the stream by applying the control signal to an electro-actuatable element mechanically coupled to the droplet generator; and controlling jitter of the stream by controlling an amplitude of the second periodic waveform.

18. A method of assessing a condition of a droplet generator adapted to deliver a stream of liquid target material to an irradiation region in a system for generating EUV radiation, the method comprising the steps of:

providing the stream of liquid target material for a plasma generating system from the droplet generator;

generating a control signal, the control signal comprising a hybrid waveform including a superposition of a first periodic waveform and a second periodic waveform;

introducing a velocity perturbation into the stream by applying the control signal to an electro-actuatable element mechanically coupled to target material in the droplet generator;

adjusting a relative phase of the second periodic waveform with respect to the first periodic waveform;

observing the stream to determine whether coalescence occurs at the relative phase;

repeating the adjusting step and the observing step to determine a range of relative phases at which coalescence occurs;

assessing the condition of the droplet generator based on the determined range.

* * * * *